US005201827A

United States Patent [19]

Glover et al.

[11] Patent Number: 5,201,827

[45] Date of Patent: Apr. 13, 1993

[54] SLACKLESS DRAWBAR SYSTEM

[75] Inventors: Mary A. Glover, Pittsburgh; Peter S. Mautino, Verona, both of Pa.

[73] Assignee: McConway & Torley Corporation, Pittsburgh, Pa.

[21] Appl. No.: 855,439

[22] Filed: Mar. 23, 1992

[51] Int. Cl.[5] ..... B61G 7/00

[52] U.S. Cl. ..... 213/61; 213/50; 213/50.5; 213/56

[58] Field of Search ..... 213/50, 50.5, 51, 56, 213/57, 58, 60, 61, 62 R, 62 A, 63, 67 R, 69, 70, 71, 72; 384/276, 280

[56] References Cited

U.S. PATENT DOCUMENTS

| | | | |
|---|---|---|---|
| 175,943 | 4/1876 | Dalzell | 384/280 |
| 3,760,954 | 9/1973 | Hershey et al. | 213/50.5 |
| 4,456,133 | 6/1984 | Altherr et al. | 213/62 R |
| 4,531,648 | 7/1985 | Paton | 213/50 |
| 5,035,338 | 7/1991 | Kaufhold et al. | 213/50 |

FOREIGN PATENT DOCUMENTS

| | | | |
|---|---|---|---|
| 0961446 | 1/1975 | Canada | 213/62 R |
| 0905627 | 12/1945 | France | 384/280 |
| 0029814 | 2/1984 | Japan | 384/280 |
| 0236452 | 6/1945 | Switzerland | 384/280 |
| 1284629 | 8/1972 | United Kingdom | 384/280 |
| 2187803 | 9/1987 | United Kingdom | 384/280 |

*Primary Examiner*—Mark T. Le
*Attorney, Agent, or Firm*—James Ray & Associates

[57] ABSTRACT

A slackless drawbar system includes a support member comprising a top plate, a bottom plate and a pair of spaced apart side plates joining the top and bottom plates to form a hollow rectangular member closely fitting inside the rectangular longitudinal opening of a railway car center sill. A back wall joins the top and bottom plates and the pair of side plates at a point spaced from one end of the support member and the top and bottom plates are provided with aligned bores each of which has a bushing therein, one of which bushings receives one end of a cylindrical pivot pin and the other of which bushings receives the other end of the pivot pin. The side plates of the support member are secured to the railway car center sill through weld slots in the center sill and at weld chamfers provided at each end of each of the side plates. The support member also includes reinforcing ribs connecting the back wall to the side plates and to the top and bottom plates. A slot is provided in the support member running from the top of the top plate to the bottom of the bottom plate for receiving a follower and slack take-up wedge. A follower support plate and a pivot pin support plate are also provided and are removable secured to the flanges of the railway car center sill.

20 Claims, 3 Drawing Sheets

SLACKLESS DRAWBAR SYSTEM

FIELD OF THE INVENTION

This invention relates to drawbar coupling systems and in particular to a slackless drawbar system having a fixed pivot pin. The invention is described and illustrated in connection with a railway application where it may be commonly used to connect cars in a dedicated service such as coal or ore operation or container service. In these applications it is not necessary to provide standard Association of American Railroads (AAR) couplers and/or draft gear since the cars are only rarely uncoupled but it is desirable to avoid impacts due to the take-up of slack which can cause damage to equipment and/or lading.

A co-pending application relating to this application is U.S. patent application Ser. No. 07/855,521, filed Mar. 23, 1992 with the title of "SLACKLESS DRAWBAR" and assigned to the assignee of the present invention. The disclosure contained therein is incorporated herein by reference thereto.

BACKGROUND OF THE INVENTION

The avoidance of shock loads caused by the take-up of slack between cooperating elements of the system through which draft and buff loads are applied to a train during in-track operation, has long been a concern of railway operators. In some dedicated train operations it is advantageous to avoid the weight and cost of standard AAR couplers and draft gear by replacing them with light-weight, simple drawbars but this means that slack takeup and impact dissipation systems included in the eliminated equipment are also eliminated. Therefore it has been a goal in designing drawbar systems to eliminate slack. It is also desirable to keep the apparatus light in weight, strong enough to withstand maximum draft and buff loads and flexible enough to handle side to side and fore and aft angling as required by AAR rules to meet operating conditions.

Slackless systems have been provided before, for example U.S. Pat. No. 4,580,686 illustrates a wedge-shaped slack take-up member and U.S. Pat. No. 4,966,291 shows a notary drawbar. The disclosures of the above patents are incorporated herein by reference and made a part of this disclosure.

SUMMARY OF THE INVENTION

This invention provides improvements over U.S. Pat. Nos. 4,580,686 and 4,966,291. The invention comprises a support member or casting adapted to be directly secured to the center sill of a railway car and which in turn supports all the other parts of a drawbar system. This casting also protects the center sill from excessive wear caused by the drawbar system. The invention further comprises a pivot pin through which draft load is transmitted from a drawbar to the support member, a pair of bushings fixed in the support casting for spreading the load from the drawbar over a relatively broad area of the support casting, a follower for transferring buff loads to the butt end of the drawbar and a slack adjusting wedge for taking up slack between operative parts of the system and maintaining the follower in close contact with the butt end of the drawbar. Suitable attaching and retaining parts are also provided. Components of the drawbar system of the invention are made of appropriate material to withstand the type of loading or stress to which each will be subjected and are hardened and/or otherwise treated as necessary to achieve the best results.

The system is designed to eliminate or reduce stress concentrations. This is accomplished in part by providing smooth transition curves between intersecting surfaces of load carrying members, enlarging the radii of load carrying curved surfaces, utilizing wear resistant steel and hardening surfaces subjected to wear. Hardened bushings are interposed between the pivot pin and the pinhole in the support casting to apply draft loads over a relatively broad surface area rather than at a high-stress contact line.

The invention is simply constructed with a minimum number of parts and can be easily assembled, disassembled and maintained without special or expensive tools. It has low wear characteristics which result in a relatively long life and can compensate for initial slack and appreciable additional wear in the draft components. When such wear reaches the maximum which can be compensated for, the wear-compensating member can be easily replaced by a thicker member for additional life of the system. Visual wear indications are provided which are readily observable from either the top or the bottom of the assembly showing when the system has reached its useful limit of compensation for slack. The wear-compensating member can be removed from the bottom of the assembly by removing bolts holding a support plate.

While it is recognized that a slackless draft system incurs reduced load levels in both draft and buff conditions, the invention is capable of handling the same ultimate loads as a conventional system, i.e., at least about 900,000 pounds in draft and at least about 1,200,000 pounds in buff. This permits use of the invention in trains which include conventionally coupled cars.

Further the invention is designed so that it can readily be applied to a conventional railway car having a center sill with a minimum amount of modification of the center sill being required and eliminates the need for installation of draft stops.

This invention provides a drawbar system which avoids shocks and excess loads caused by slack, yet is lighter in weight and is capable of handling the same maximum draft and buff loads as previously know apparatus.

The drawbar system of this invention when used with the drawbar described in copending application Ser. No. 07/855,521 is significantly lighter than a standard AAR coupler and draft gear permitting a reduction in energy costs and/or a greater payload.

OBJECTS OF THE INVENTION

It is an object of this invention to provide a slackless drawbar system that can readily be applied to a standard railway car without requiring any modification of the car.

Another object of this invention is to provide a slackless drawbar system which offers a substantial savings in weight over conventional coupler and draft gear systems.

It is also an object of this invention to provide slackless drawbar system which avoids slack in both draft and buff modes.

Still another object is to provide such a system specifically designed to avoid high stress concentration and high wear areas for reliability and long life.

These and other objects and advantages will become apparent from the attached drawings and written description.

DESCRIPTION OF THE PREFERRED EMBODIMENT

Figure 1:
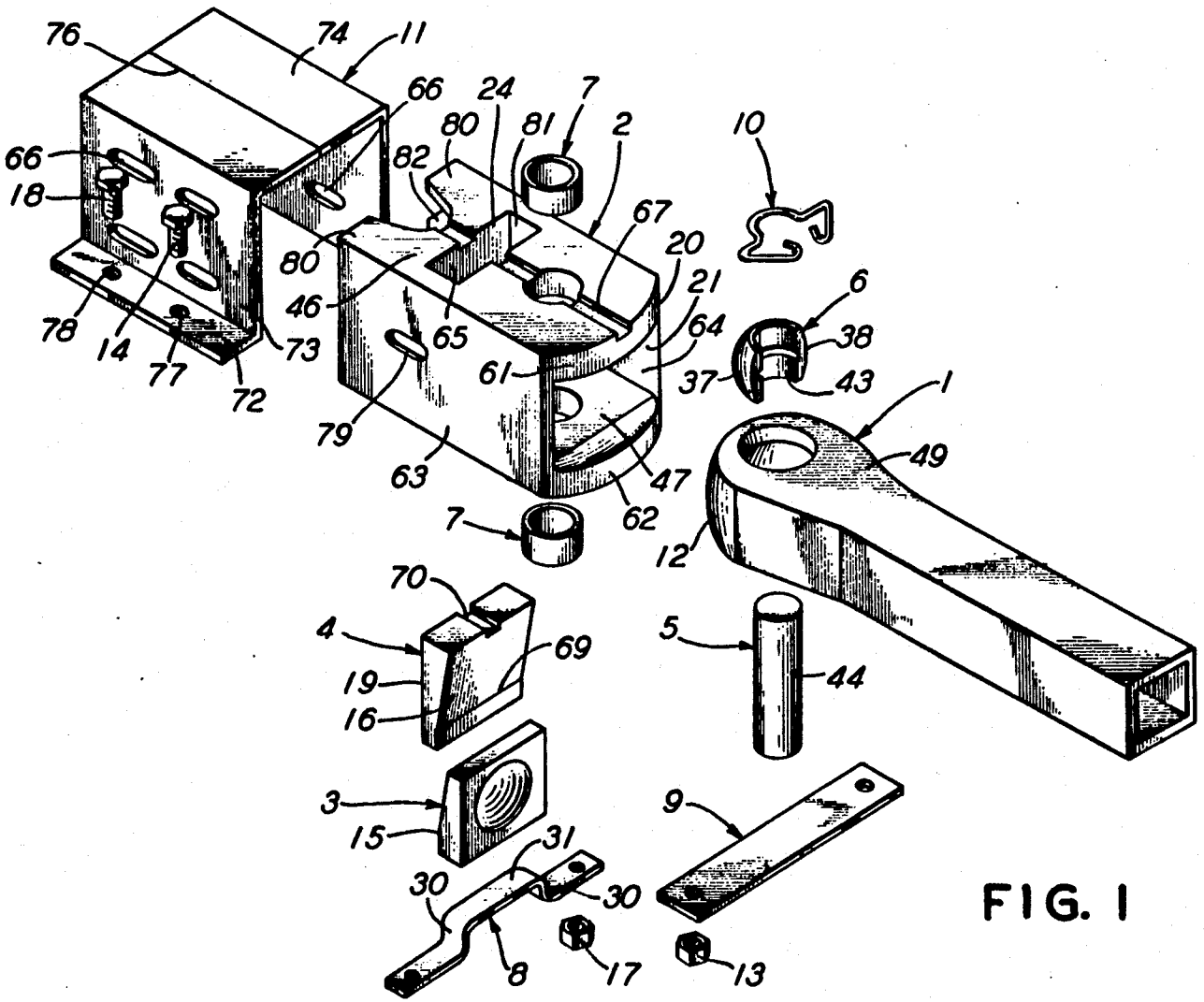
FIG. 1 is an exploded view of the elements of a slackless drawbar system utilizing the support member or casting of the invention.
Figure 2:
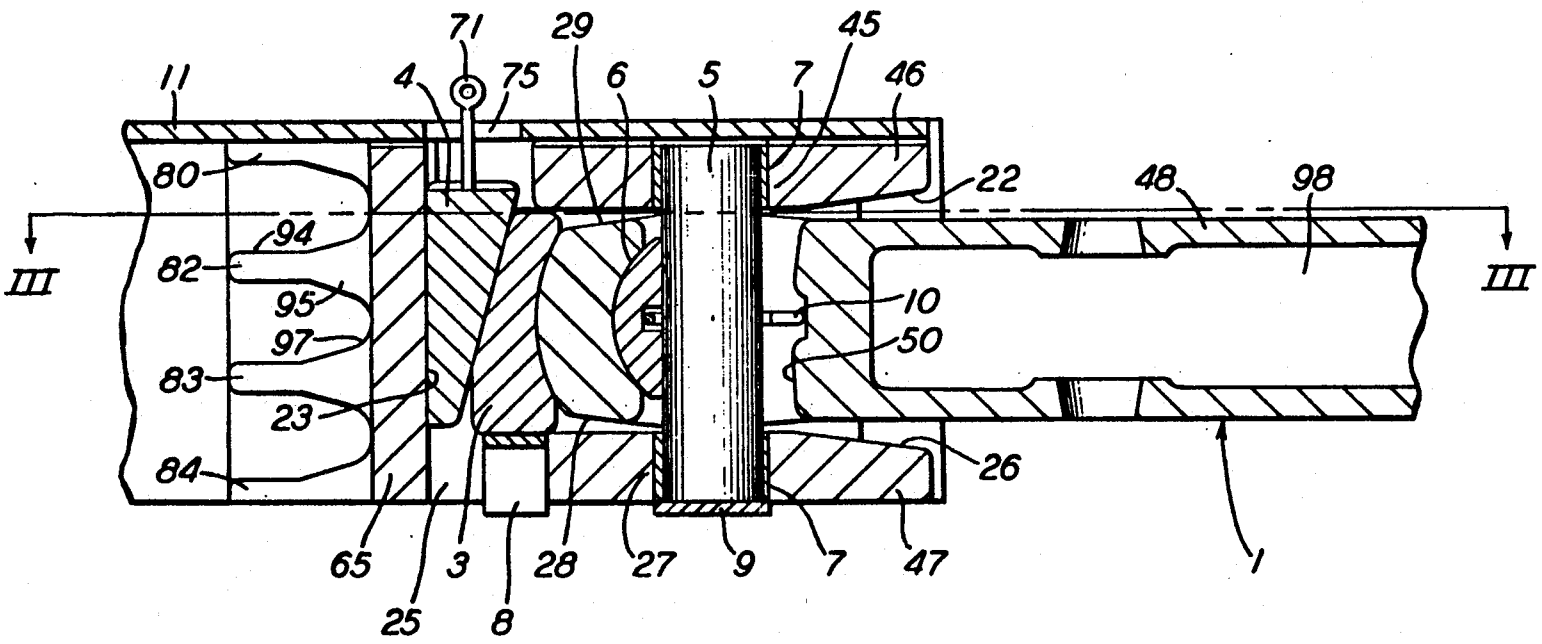
FIG. 2 is a cross-sectional view taken along line II—II in FIG. 3 of the support member of this invention shown connected between a drawbar and a railway car center sill.

As can be seen in FIG. 1, the slackless drawbar system of the invention comprises a drawbar 1 which fits into a support member or casting 2 in contact with a follower 3 which is held in close contact with the butt or inner end 12 of the drawbar by a slack take-up wedge 4. Draft force is applied from drawbar 1 to support casting 2 through bearing block 6, pin 5 and bushings 7. Buff load is applied from car sill 11, through support member 2, wedge 4 and follower 3, to the butt end 12 of drawbar 1. Bearing block 6 may be held in position in drawbar 1 by a retaining clip 10. As more fully described hereinafter the parts of the drawbar assembly are maintained in working relationship by support casting 2 and the assembly is attached to the car by welding support casting 2 to the center sill of the car. As can be seen in FIG. 2, pin 5 is supported within the drawbar 1 and support casting 2 by a pin support plate 9 which is secured to the center sill by removable means such as nuts 13 and bolts 14 which are placed in holes 77 in the flanges 72 of a railway car center sill. Follower 3 and wedge 4 have cooperating oppositely inclined faces 15 and 16 respectively which allow the wedge 4 to drop by gravity to compensate for slack in the drawbar system. The angle of the incline is selected to permit easy downward movement of the wedge by gravity but to inhibit upward movement particularly under buff loads. This angle is approximately 14°. The follower is maintained in its proper vertical position in alignment with the butt end 12 of a drawbar by a follower support plate 8 which is secured to the center sill by removable means such as nut 17 and bolt 18 which are placed in holes 78 in the flanges 80 of a railway car center sill. The wedge 4, follower 3 and support casting 2 are constructed and arranged so that about one inch of slack can be compensated for without detrimental effect on the load carrying capabilities of the drawbar system. When this limit is reached the wedge can be removed and replaced with a wedge of the same configuration except that the thickness of the wedge at any given point between the inclined face 16 and the vertical face 19 will be greater that the corresponding thickness of the wedge being replaced.

Figure 3:
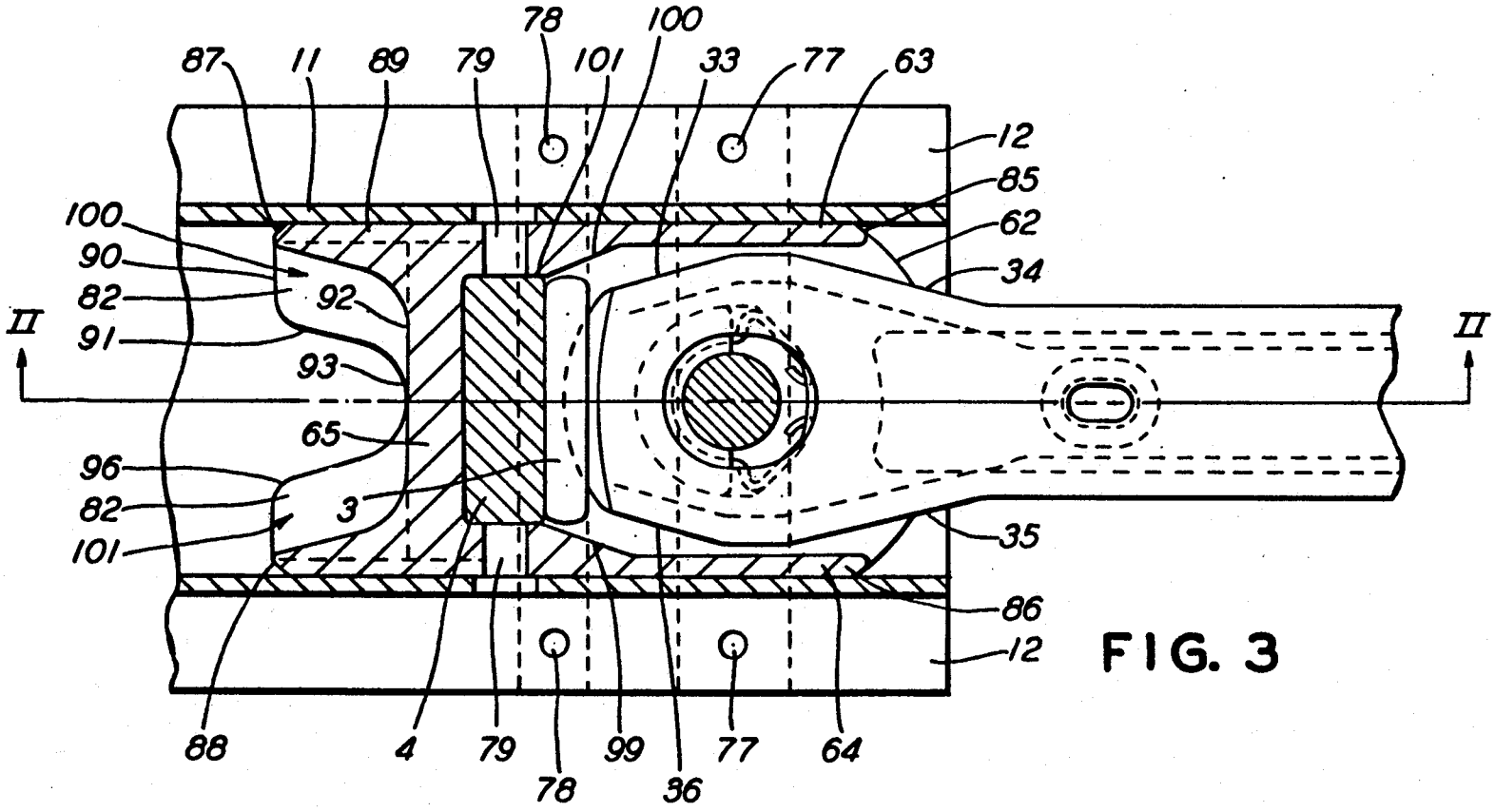
FIG. 3 is a cross-sectional view of the drawbar system of this invention taken along line III—III in FIG. 2.

As can be seen in the drawings, support member 2 has a top plate 46, a bottom plate 47, each of which has a curved front edge 61 and 62 respectively, side plates 63 and 64 and back wall 65 and back wall stiffeners or supports 80, 82, 83 and 84. Railway car center sill 11 is a standard part of a typical railway car and is usually provided with a series of weld slots 66. In a preferred embodiment at least 4 such weld slots are provided on either side of the center sill. Support member 2 can be attached to the center sill by welding through the weld slots. Center sill 11 is usually actually constructed of two Z-bars 73, 74 welded together along the line 76. A slot 67 is formed in the top of support member 2 to clear any weld material on the inner top part of center sill 11. Comparable clearance slots are also provided as needed on other parts of the system for this purpose. For example, slot 70 is provided in the top of wedge 4. Additional welds can be made along the vertical intersections of side plates 63 and 64 with the center sill 11. Support casting 2 has a generally rectangular opening 21 extending from its outer end 20 to its back wall 65 where the opening 21 intersects the middle portion 23 of a rectangular slot 81 extending from the top of top plate 46 to the bottom of bottom plate 47. The upper portion 24 of the slot 81, extends through top plate 46, the lower portion 25 extends through bottom plate 47 and with middle portion 23 they form a smooth continuous slot through support member 2. As indicated at 99 in FIG. 3 the transition from opening 21 to slot 81 may be made by a diagonal wall with fillets 100 and radii 101 to avoid sharp intersections which may cause stress concentration and to improve casting. Opening 21 has inclined surfaces 22 and 26 at its top and bottom respectively to allow rocking of the drawbar about a horizontal axis. Surface 22 is inclined upwardly from the central axis 98 of drawbar 1 and support casting 2. Surface 26 is inclined downwardly from central axis 98. Complementary inclined surfaces 28, 29 may be provided at the bottom and top respectively of the inner end 12 of drawbar 1 also to permit such rocking. Support casting 2 has aligned bores 27 and 45 extending through bottom plate 47 and top plate 46 respectively into which bores are inserted bushings 7 which in turn receive pin 5. Bushings 7 are preferably of a hard, wear resistant material and preferably are press fitted into bores 27 and 45. Pin 5 is held in its vertical position within the support casting by pin support plate 9, nuts 13 and bolts 14. The width of slot 81 is at least slightly greater than the width of wedge 4 so that the wedge can move vertically as needed without binding. Follower 3 is made so that it also has side clearance in slot 81. Follower support plate 8 serves to maintain follower 3 in its proper vertical position. Follower support plate 8 has offset portions 30 and bight portion 31 on which the follower rests when the system is assembled. As seen in FIG. 2, the offset configuration of the support plate is required to provide a substantially level surface between the support plate and the adjoining surface of bottom plate 47 to permit the follower to move longitudinally within the support casting as may be required to maintain contact with the butt end 12 of the drawbar and has the additional advantage of resulting in less metal mass in the follower and lighter weight of the system of the invention.

Inclined faces 33, 34, 35 and 36 are provided at the load support or pin end 49 of drawbar 1 to permit relative swinging motion about the axis of pin 5 when a car to which the drawbar is attached negotiates a curve.

The support member configuration described herein permits rotation of a drawbar connected thereto about a horizontal axis of about 7 degrees on either side of a vertical plane, horizontal angling about a vertical axis of about 13 degrees on either side of the longitudinal center line of the railway car center sill and twist angling about a horizontal axis lying along the longitudinal center line of the railway car center sill of about 4 degrees on either side of an vertical plane.

The portion 48 of drawbar 1 intermediate its ends is preferably tubular to reduce weight while the ends are of solid material. The load support end 49 of the drawbar has an opening 50 extending therethrough to receive pin 5. Opening 50 has an annular recess extending around approximately one-half the circumference of opening 50 nearest butt end 12 of drawbar 1. This recess is shaped and sized to receive the outer spherical surface 37 of a pin bearing or bearing block 6. Bearing block 6 is comprised of two segments 37, 38 which together form a substantially hemispherical shape. The inner surface 43 of bearing block 6 is semicylindrical and made to closely engage the outer surface 44 of pivot pin 5. Opening 50 is flared adjacent its ends to permit limited rocking motion of drawbar 1 with respect to the vertical axis of pin 5.

As can be seen in the drawings, support member 2 has an exterior which closely conforms to the size and configuration of the inside of a railway car center sill. As previously described, the support member is welded to the center sill by welding through the weld slots 66 and along the vertical edges at the front and back ends of side plates 63 and 64. Weld chamfers 85, 87 and 86, 88 are provided at the front and rear edges respectively of side plates 63 and 64 respectively of support casting 2 to facilitate welding.

A series of support ribs or stiffening webs 80, 82, 83 and 84 are also provided to strengthen and stiffen back wall 65 of the support casting. Each rib has a first portion 100 which has a first edge 89 beginning at the rearwardmost edge 102 of a sideplate and extending along the inside surface of said side plate to the back wall 65, a second edge 90 which begins at the intersection of said first edge and the rearwardmost edge of said side plate and extends about a quarter of the distance between the two side plates 63 and 64 along a line substantially perpendicular to the outer surface of the sideplate to which the respective rib is attached. Each rib has a third edge 91 extending from the free end of the second edge and running along a line resembling a quarter of a sinusoidal curve to an intersection with a surface of the back wall 65 at a point 93 approximately midway between the two side plates 63 and 64. Each rib also has a fourth edge 92 which is joined to the rearward surface of the back wall and runs in a flat plane to connect the third edge 91 to the first edge 89 of the rib. Each rib has a second portion 101 which is a mirror image of the first portion and extends from point 93 to and connecting with the opposite side plate. Both portions of each rib are aligned with each other and lie along a common plane. As can best be seen in FIG. 2 the first and second portions of each reinforcing rib have a tooth-like symmetrical cross-section with a relatively thin first area 94 and a base 95 diverging to either side of the first area to a junction with the back wall 65. In the case of ribs 80 and 84 which are adjacent to top plate 46 and bottom plate 47 respectively of the support member 2, the bases diverge only in the direction opposite the location of the top and bottom plates. The intersection between the second and third edges 90 and 91 respectively of each rib portion is rounded to a smooth curve 96. Similarly the cross-section of the portion between the base portions 95 of adjoining reinforcing ribs is also formed in a smooth curve 97. The configuration of the ribs is selected to meet several criteria as follows:

(1) to provide maximum support for back wall 65;
(2) to avoid excess weight consistent with the need to provide support;
(3) to enable casting of the support member in one integral piece without need for post-casting machining or other operations;
(4) to avoid problems such as "hot tears" in the casting; and
(5) to avoid sharp intersections which produce stress concentrations.

Hot tears are breaks or tears which occur in a thin section of a cast member which thin section has cooled and solidified before an adjacent relatively thick section solidifies and which thin section is put under severe tensile stress which causes tears or breaks when the thicker section subsequently cools, shrinks and solidifies.

Without the webs 80, 82, 83 and 84 back wall 65 is subject to severe deflections which produce high stress values. The webs or ribs reduce the deflection of back wall 65 and the forces and stresses to which it is subjected. Back wall 65 in conjunction with the reinforcing ribs act like a draft stop. The best stress patterns are obtained when the support casting 2 is secured to the center sill by welds through the weld slots 66, along the weld grooves or chamfers 85, 86 at the front edges of the side plates 63, and 64 and along the weld grooves or chambers 87, 88 at the rear edges of the side plates.

To facilitate assembly of the follower 3 and wedge 4 into the support casting 2 an assembly hole 79 is provided which extends completely through side plates 63 and 64 in alignment with a weld slot 66 or an opening especially made in the center sill on either side. A suitable assembly pin (not shown) can be inserted in the assembly hole 79 through the side plates to support the wedge until follower support plate 8 is bolted to the flanges 72 of a railway car center sill. The assembly pin can then be removed. Wedge 4 may be marked with a wear indicator 69, which may be a line or a color to indicate when it becomes visible that the wedge has reached its limit of wear compensation and must be replaced with a thicker wedge. This point is reached when the wedge projects through the bottom of slot 81 so that the mark 69 can be seen from underneath support casting 2. Slack take-up wedge 4 may also be provided with a lifting eye 71 to aid in assembling the wedge 4 and follower 3 into slot 81 from the top of the support member. For this purpose an opening 75 of suitable size and shape must be cut into the top of center sill 11 in alignment with slot 81 in the support member. The lifting eye can also be used as a wear indicator, the need to replace wedge 4 being signalled by the dropping of the top of the lifting eye below the top of the center sill or by some other suitable marking made on the lifting eye.

To avoid stress concentration and failures caused by forces applied to support casting 2 by pin 5, bushings 7 are provided. The bushings 7 are constructed of hardened material and are press fitted into bores 45 and 27 in top and bottom plates 46 and 47 respectively. This arrangement avoids concentrated stresses from an essentially line contact between pin 5 and the opening for pin 5 in the support member. In the present arrangement, drawbar forces between the pin and the support member are spread over approximately the front half of the outer surface of the bushing greatly reducing the probability of failure of the support member around the pin.

The invention was designed and made to produce superior performance and results under load conditions required by AAR for standard couplers so that the improved drawbar system could be used in a train with conventionally coupled cars. Therefore stress analysis was made with draft loads of at least about 900,000 lbs. and buff loads of at least about 1,200,000 lbs. Complete stress analyses of the support casting and drawbar were done using Finite Element Analysis (FEA).

Materials for the parts were selected to provide the best results based on the forces to be withstood, type of use and exposure to wear.

Weight is important in railway and other transportation applications and efforts were made to keep weight at a minimum consistent the need to meet strength and wear requirements. An example of the properties of a preferred embodiment of the invention follows.

The support casting is preferable made of AAR Grade "B" steel to provide good welding and casting characteristics and weighs about 470 lbs. The follower and wedge are made of AAR Grade "E" steel and weigh about 45 lbs. and 49 lbs. respectively. The pin can be a 3½" AISI 8620 steel pin weighing about 33 lbs. The pin is substantially similar to the standard AAR type Y47 pin but is of longer length. The follower and butt end 12 of the drawbar will be in constant contact and the contact areas between them will be subject to high wear. These areas are preferably flame hardened to provide better wear characteristics. The bushings are preferably made of a hard steel such as AISI 1524 or AISI 8620 and weigh about 5 lbs. each. The support plates 8 and 9 are preferably made of AISI 1040 or comparable steel and will weigh about 12 lbs. each.

While the present invention has been described and shown in connection with preferred embodiments, it is apparent that other embodiments may be derived and modifications or changes may be made to the invention as shown and described herein. Therefore the scope of the invention should be construed and limited only in accordance with the appended claims.

We claim:

1. In a slackless drawbar system for attachment to one end of a railway car having a center sill equipped with weld slots and a longitudinal opening of generally rectangular cross-section;

a support member of generally rectangular external cross-section closely fitting inside such opening in such center sill and comprising a top plate, a bottom plate, a pair or spaced apart side plates joining said top plate and said bottom plate to form a generally hollow rectangular member and having welding chambers at each of their ends to enable securement of said support member to such center sill by welding, a back wall joining said top plate and said bottom plate and said pair of side plates at a point spaced from one end of said support member, a pair of aligned bores in said top plate and said bottom plate located between said back wall and said one end of said support member, and a bushing in each of said aligned bores, one receiving one end and another receiving another end of a cylindrical pivot pin.

2. A support member, as set forth in claim 1, further comprising at least one reinforcing rib extending between said pair of side plates and secured thereto and to said back wall on a side of said back wall remote from said one end of said support member.

3. A support member, as set forth in claim 1, further comprising a slot extending from a top of said top plate to a bottom of said bottom plate, said slot being located between said back wall and said pair of aligned bores.

4. A support member, as set forth in claim 2, wherein said top plate, said bottom plate, said pair of side plates, said back wall and said at least one reinforcing rib are integral with each other.

5. A support member, as set forth in claim 2, wherein said support member includes one rib adjacent to and integral with said top plate, one rib adjacent to and integral with said bottom plate and at least one rib integral with said back wall and spaced from said top plate and said bottom plate.

6. A support member, as set forth in claim 3, wherein said slot is contiguous with said back wall.

7. A support member, as set forth in claim 1, wherein an end of said top plate and said bottom plate at said one end of said support member is formed in a curve convex outwardly form said one end of said support member.

8. A support member, as defined in claim 4, wherein said support member is an integral casting.

9. A support member, as defined in claim 3, wherein a space between said side walls is greater than a width of said slot and there is a sloping transition wall extending from each of said side walls to an adjacent edge of said slot.

10. A support member, as defined in claim 7 wherein opposing surfaces of the curved ends of said top plate and said bottom plate slant outwardly away from each other.

11. A slackless drawbar system for attachment to one end of a railway car having a center sill with a longitudinal opening of generally rectangular cross-section, said system comprising a support member, a drawbar having a convex butt end at its first end and a load support portion adjacent thereto, a pivot pin in said load support portion for transmitting draft forces from said drawbar, a follower in contact with said butt end for transmitting buff loads to one of said drawbar and said support member and a slack take-up wedge in contact with said follower;

said support member including a bottom plate of generally rectangular configuration, and having a predetermined length and width;

a top plate of generally rectangular configuration overlying said bottom plate and having a predetermined length and width substantially equal respectively to said predetermined length and width of said bottom plate;

a pair of side plates of generally rectangular configuration and substantially identical to each other joined along their lengthwise edges to opposed edges along said length of said top plate and said bottom plate to form an elongated generally hollow rectangular member having an external cross-section closely matching an internal cross-section of such longitudinal opening in such center sill;

means in said top plate and said bottom plate for securing said pivot pin therein and providing a connection for transmitting draft forces from said drawbar to said support member;

a back wall joining said top plate and said bottom plate and said pair of side plates at a point intermediate the ends of said support member;

a slot adjacent one side of said back wall for receiving said follower and said slack take-up wedge, said slot being located between said back wall and said means in said top plate and said bottom plate for securing said pivot pin whereby said back wall holds said slack take-up wedge in contact with said follower to thereby maintain said follower in contact with said butt end of said drawbar;

and means for rigidly securing said support member to such center sill.

12. A slackless drawbar system, as set forth in claim 11, wherein said means in said top plate and said bottom plate for securing said pivot pin therein includes aligned bores in said top plate and said bottom plate and bushings in each of said bores to receive opposite ends of said pivot pin.

13. A slackless drawbar system, as set forth in claim 12, wherein said bushings are hardened.

14. A slackless drawbar system, as set forth in claim 13 wherein said bushings are press-fitted into said bores.

15. A slackless drawbar system, as set forth in claim 11, further including at least one reinforcing rib extending between said pair of side plates and attached to said back wall.

16. A slackless drawbar system, as set forth in claim 11, wherein such center sill includes welding slots, said pair of side plates each have welding chambers at each of their ends and said support member is securable to such center sill by welds in such welding slots and at each of said welding chambers.

17. A slackless drawbar system, as set forth in claim 11, wherein said pair of side plates have aligned assembly holes which permit insertion of an assembly pin therethrough to temporarily support said slack take-up wedge during initial assembly of said drawbar system.

18. A slackless drawbar system, as set forth in claim 15, wherein said at least one reinforcing rib has a first portion which has a first edge beginning at a rearwardmost edge of one of said side plates and extending along an inside surface of said side plate to said back wall, a second edge which begins at an intersection of said first edge and a rearwardmost edge of said side plate and extends to a point about a quarter of a distance between said pair of side plates, a third edge extending from said point to a second point on a surface of said back wall about midway between said pair of side plates and a fourth edge joined to said surface of said back wall and connecting said second point to said first edge.

19. A slackless drawbar system, as set forth in claim 18, wherein said intersection between said second edge and said third edge is rounded to avoid stress concentration and improve castability.

20. A slackless drawbar system, as set forth in claim 18, wherein said at least one reinforcing rib has a second portion which is a mirror image of said first portion, said second portion beginning at said second point and extending to the other of said side plates.

* * * * *

UNITED STATES PATENT AND TRADEMARK OFFICE

CERTIFICATE OF CORRECTION

PATENT NO. : 5,201,827

DATED : April 13, 1993

INVENTOR(S) : MaryAnn Glover et al.

It is certified that error appears in the above-identified patent and that said Letters Patent is hereby corrected as shown below:

Col. 7, line 50, delete "chambers" and insert --chamfers--

Col. 8, line 18, delete "form" and insert --from--

Col. 9, line 22, delete "chambers" and insert --chamfers--

Col. 9, line 25, delete, "chambers" and insert --chamfers.

Signed and Sealed this

Eighteenth Day of January, 1994

*Attest:*

Bruce Lehman

BRUCE LEHMAN

*Attesting Officer*

*Commissioner of Patents and Trademarks*